US006279819B1

(12) United States Patent
Schultz

(10) Patent No.: US 6,279,819 B1
(45) Date of Patent: Aug. 28, 2001

(54) RECLOSEABLE, CUBOIDAL FOLDING BOX WITH HANGING MEANS

(75) Inventor: Günther Schultz, Hamburg (DE)

(73) Assignee: Beiersdorf AG, Hamburg (DE)

( * ) Notice: Subject to any disclaimer, the term of this patent is extended or adjusted under 35 U.S.C. 154(b) by 0 days.

(21) Appl. No.: 09/390,119

(22) Filed: Sep. 3, 1999

(30) Foreign Application Priority Data

Oct. 22, 1998 (DE) ..... 198 48 719

(51) Int. Cl.[7] ..... B65D 5/46; B65D 5/54
(52) U.S. Cl. ..... 229/117.14; 229/223; 206/806
(58) Field of Search ..... 229/117.14, 122.32, 229/152, 223; 206/806

(56) References Cited

U.S. PATENT DOCUMENTS

| | | | | |
|---|---|---|---|---|
| 1,522,311 | * | 1/1925 | MacLellan | 229/117.14 |
| 4,062,486 | * | 12/1977 | Goodrich | 229/223 |
| 4,171,763 | * | 10/1979 | Card | 229/117.14 |
| 4,291,807 | * | 9/1981 | Giordano et al. | 206/806 |
| 4,331,240 | * | 5/1982 | Vanasse | 206/806 |
| 4,344,533 | * | 8/1982 | Olsen | 229/223 |
| 5,722,585 | | 3/1998 | Redl . | |
| 5,878,948 | | 3/1999 | Schultz et al. . | |

FOREIGN PATENT DOCUMENTS

| | | |
|---|---|---|
| 39 32 441 | 4/1991 | (DE) . |
| 3932441 | 4/1991 | (DE) . |
| 91 11 984 | 1/1992 | (DE) . |
| 4322555A1 | 1/1995 | (DE) . |
| 19535008A1 | 3/1997 | (DE) . |
| 19541904A1 | 5/1997 | (DE) . |
| 196 37 022 | 3/1998 | (DE) . |

* cited by examiner

*Primary Examiner*—Gary E. Elkins
(74) *Attorney, Agent, or Firm*—Norris McLaughlin & Marcus

(57) ABSTRACT

A recloseable, cuboidal folding box which has a tamper-proof seal and a hanging means both of which are provided in the top region of the folding box, and which can be erected, filled and closed easily and quickly with the aid of machines, and which is prepared from a single-piece folding blank.

7 Claims, 5 Drawing Sheets

RECLOSEABLE, CUBOIDAL FOLDING BOX WITH HANGING MEANS

The invention relates to a recloseable, cuboidal folding box. The box has a front side wall, a rear side wall, a right-hand side wall, which connects the front side wall and the rear side wall, a left-hand side wall, a base closure, and a top closure. The base closure is formed by four base closure flaps, and he top closure is formed by four top closure flaps, two closure flaps and two base closure flaps being adhesively bonded to one another A tear-open tab is integrated in the rear side wall, is retained in the rear side wall by means of a weakening or predetermined tearing line and is connected to a closure flap of the top closure via a folding line. The box has at least one inner rear wall on which if appropriate an intermediate wall and, adjoining the intermediate wall, an inner front wall are articulated.

BACKGROUND OF THE INVENTION

German Patent Application DE 39 32 441 discloses a recloseable folding box which comprises a front side wall and a rear side wall as well as two side walls which connect the front side wall and the rear side wall, a base part and a top closure flap. The closure flap is connected, via a fastening tab, to an insertion tongue which, for its part, is arranged in the rear side wall or front side wall via a weakening line and can be torn out of said side wall. This folding box, however, does not provide any possible means for hanging it on a hook in any way. Once said folding box has been filled with the goods which are to be sold, it has to be displayed to the customer in a manner which shows it to best effect and which allows it to be handled easily. A very clearly laid-out display may be provided in sales racks by means of the generally known self-service hooks, which make it possible for a plurality of folding boxes to be received one behind the other. In order that the folding box described can be hung on such a hook, a correspondingly shaped blank with a hanging device has to be fitted on the folding box in addition. This usually takes place by this part with the corresponding hanging device being adhesively bonded on the folding box at a suitable location in an additional operation. However, the production process of the folding box is thus made more complicated, inter alia, as a result of the production of the further blank or the adhesive bonding of the latter on the finished box, and the greater number of operating steps increases the amount of time required for the production process; furthermore, this means a very much higher outlay in terms of apparatus.

German Patent Application DE 43 22 555 likewise discloses a recloseable, cuboidal folding box. This folding box comprises a rear side wall, which is formed by an outer side-wall part and an inner side-wall part, a front side wall, two side walls which connect the front side wall and the rear side wall, a base closure and a top closure. The outer side-wall part has, in its top region, a hanging tab with a correspondingly shaped hanging device, for example round holes or slots. The hanging tab can be used to position the folding box on a hook. However, since the hanging tab is merely of single-layer design and consists of the same material as the rest of the folding box, problems arise during practical usage of the folding box. If, taking into consideration environmental reasons and reasons of cost, the folding box is produced from thin material, the hanging tab has insufficient stability. Even if the folding box is subjected to a slight, unintentional pulling action, the hanging tab tears off, with the result that the hanging tab loses its function and it is no longer possible for the box to be hung up as desired.

Furthermore, the appearance of the box is adversely effected as a result and it is no longer possible for the box to be displayed to the customer. Conversely, producing the folding box from thicker, more stable material means that, although the hanging tab can be subjected to tensile loading to a very much greater extent, a large amount of material is wasted unnecessarily at the same time because the rest of the walls of the folding box are over-dimensioned.

American U.S. Pat. No. 4,344,533 describes a box which has a hanging means which is made up of two individual hanging tabs. However, this box has several disadvantages as far as its production and use are concerned. The blank of the box disclosed in the American patent has a vertical construction, i.e. the two hanging tabs and the end tab, which together form the hanging means of the box, are arranged in a straight line with the four side walls, the individual parts being connected to one another by a folding line in each case. This type of folding blank means that, once the body of the box has been assembled, the box can only be filled from the side and not, as is generally customary and desired, from above. This makes it necessary to use cartoning and filling machines which are specifically designed for this blank and are otherwise rather unconventional. Furthermore, when the box has been completed, there is a section, in the region of the hanging means, which has a threefold material thickness, as a result of three walls located one above the other, and is thus over-dimensioned. This makes the box more expensive to produce, as a result of increased material consumption, and at the same time results in the weight of the box increasing, with the generally known disadvantages. It is only possible to open the box by first of all a strip of material over the actual opening being removed in an irreversible manner and thus ending up as waste, which, from current environmental standpoints, is undesirable. The box is then torn open at a perforation line. The box can only be reclosed by the hanging means, following corresponding folding, simultaneously serving as a closure cover and being pushed into the opening of the box. This rules out the possibility, once the box has been opened for the first time and closed again, of the box being hung up again by its actual hanging means. The hanging means thus loses its original, actual function. Furthermore, it is not possible to rule out the situation, during closure of the box, where the closure cover, in particular when the box is no longer completely full, slips, in an uncontrolled manner, too far into the interior of the box, with the result that it is no longer possible to grip said closure cover and the box can then only be opened with very great difficulty. Finally, the simultaneous use of the hanging means as a closure cover for the box means that when the box is still sealed, in particular when the box is of a large overall depth, a large, bulky hanging means is produced. This results, for example, in the box taking up a very large amount of surface area when it is hung up in a rack, with the result that the actual capacity of the rack can only be utilized insufficiently by the boxes disclosed.

DE 195 41 904 discloses a similar folding box. The folding box comprises a front side wall, a rear side wall, a right-hand side wall, which connects the front side wall and the rear side wall, and a left-hand side wall. The box has a base closure, which is formed by four base closure flaps, and a top closure, which is formed by four closure flaps, two closure flaps of the top closure and two base closure flaps being adhesively bonded to one another. Furthermore, integrated in the front side wall or in the rear side wall is a tear-open tab which is retained in the front side wall or the rear side wall by means of a weakening or predetermined tearing line and is connected to a closure flap of the top closure or to a base closure flap of the base closure via a folding line. At least one inner rear wall is provided in the folding box, to be precise if the tear-open tab is located in the rear side wall. In the case where the tear-open tab is located in the front side wall, then an intermediate wall and, adjoining the intermediate wall, an inner front wall are articulated. Articulated on the rear side wall, in the region of the latter which is free of the tear-open tab, is a first hanging tab, which is located in the plane formed by the rear side wall and has a hanging device, such as slots or round holes. At the same time, a second hanging tab with a hanging device, such as slots or round holes, is punched out of the same region of the inner rear wall as in the case of the rear side wall, starting from the folding line between the inner rear wall and closure flap, it being the case that the closure flap which is articulated on the inner rear wall is of a greater width at the folding line than the second hanging tab.

DE 195 35 008 has disclosed a recloseable, cuboidal folding box having a front side wall, a rear side wall, a left-hand side wall, which connects the front side wall and the rear side wall, and a right-hand side wall. The box has a recloseable base, preferably comprising three base closure flaps articulated on the side walls, and three further closure flaps, which are articulated on the front side wall, on the left-hand side wall, which connects the front side wall and the rear side wall, and on the right-hand side wall and which are located opposite the base closure flaps, and having a fourth closure flap, which is articulated on the rear side wall and which, together with the three further closure flaps, forms the top closure of the folding box, this making it possible to have a secure and stable means of hanging the folding box on the known self-service hooks of sales racks within shops or pharmacies. The fourth closure flap is made up, according to the invention, of a plurality of sections, to be precise of p1 a first hanging tab with a hanging device, which is articulated on the rear side wall of the folding box via a folding line, there being articulated on the first hanging tab, via a folding line, a second hanging tab with a hanging device, there being articulated on the second hanging tab, via a folding line, an end tab, it being the case that the first hanging tab, the second hanging tab and the end tab are arranged one behind the other in a straight line, it being the case that the three further closure flaps and the fourth closure flap are each articulated on the same side of the four side walls, and it being the case that, when the folding box has been completed, the end tab is adhesively bonded to the closure flap articulated on the front side wall.

This folding box has a double-layer hanging means, but does not have a tamperproof seal which is recloseable.

The disadvantage with all the boxes known from the prior art is that, in so far as they have the tamperproof seal disclosed by DE 43 22 555, the hanging means is always provided on that side of the folding box which is located opposite the tamperproof seal, i.e. in the base region of the folding box when said folding boxes are ones with a single-part blank. For the reasons specified above, the task of adhesively bonding a hanging means on the box subsequently is always to be avoided.

It is annoying for the customer if the hanging means of the folding box and the closure are arranged on opposite sides of the folding box. Experience has shown that the customer takes the folding box in his/her hand and opens it at the top, that is to say in the vicinity of the hanging means, by irreversibly tearing open, and destroying, the folding box. Subsequent closure of said folding box is no longer possible. The customer who has had a little more experience of such boxes opens the folding box, as envisaged, at the tamperproof seal, removes the desired product, for example a plaster, and then closes the box again. If the latter is then hung on a hook by the hanging means, the closed closure is located at the bottom. It is thus not possible to rule out the situation where the folding box comes open unintentionally and the products located therein drop out. The task of the invention is to solve the problems described.

The object of the invention is to provide a recloseable, cuboidal folding box which has a tamperproof seal and a hanging means which are both provided in the top region of the folding box, of which the hanging means has a high stability, with as little material being used as possible, which can be produced cost-effectively, with as little material being used as possible, which can be erected, filled and closed easily and quickly with the aid of machines, and of which the folding blank along with the integrated hanging means is in a single piece.

SUMMARY OF THE INVENTION

This object, on which the invention is based, is achieved by the reclosable, cuboidal floding box of the present invention.

DETAILED DESCRIPTION OF THE INVENTION

The recloseable, cuboidal folding box according to the invention thus comprises a front side wall, a rear side wall, a right-hand side wall, which connects the front side wall and the rear side wall, and a left-hand side wall. The folding box has a base closure, which is formed by four base closure flaps, and a top closure, which is formed by four closure flaps, it being possible for two base closure flaps to be adhesively bonded to one another. Furthermore, integrated in the rear side wall is a tear-open tab which is retained in the rear side wall by means of a weakening or predetermined tearing line and is connected to a closure flap of the top closure via a folding line. Provided in the folding box is at least one inner rear wall on which if appropriate an intermediate wall and, adjoining the intermediate wall, an inner front wall are articulated. Articulated on the front side wall is a top closure flap which is made up a) of a tab which is articulated on the front side wall via a folding line, b) of a first hanging tab with a hanging device, which is articulated on the tab via a folding line, c) of a second hanging tab with a hanging device, which is articulated on the first hanging tab via a folding line, d) of an end tab, which is articulated on the second hanging tab via a folding line, it being the case that e) the sum of the width of the tab and of the end tab is no greater than the width of the top closure flap.

The inner rear wall and the rear side wall may be adhesively bonded to one another, in order to increase the stability of the folding box.

In a preferred embodiment of the folding box, the dimensions of the first and second hanging tabs correspond, and the hanging device in the first hanging tab is advantageously of larger dimensions than the hanging device in the second hanging tab, to be precise in order to ensure that, despite the unavoidable inaccuracy during the folding operation of the folding box, the requirements for the dimensions of the opening, which is formed from the hanging devices located, possibly not completely, one above the other, are fulfilled.

Furthermore, the two hanging tabs may also be adhesively bonded to one another, in order to increase the stability of the hanging means of the folding box, which is formed from the two hanging tabs.

In order to make it possible for the customer, once he/she has purchased the box, to remove the hanging means without difficulty and without destroying the box, the folding line between the inner rear wall and the second hanging tab and the folding line between the rear side wall and the first hanging tab may be designed as a severing perforation. This makes it possible for the hanging means to be specifically severed without there being any risk of the folding box tearing.

In order that the second hanging tab achieves greater flexibility at the folding line between the inner rear wall and the second hanging tab, with the result that the second hanging tab can be bent over more easily, punched sections in the manner of knife cuts may be provided over the entire length, or merely in certain areas of said folding line.

The tab and the end tab are preferably of the same width.

In a further preferred embodiment, a swing flap is integrated in the rear side wall by means of two weakening or predetermined tearing lines and is adhesively bonded in a reversible manner by means of at least one spot of adhesive. The spot of adhesive is located on the swing flap itself or on the inner rear wall.

The swing flap preferably extends over the entire width of the front side wall or of the rear side wall. The swing flap is preferably positioned centrally on the front side wall or rear side wall.

The invention also relates to the punched blank for producing a folding box which is characterized in the claims.

The advantage of this folding box resides in the fact that the closure of the folding box and the hanging tab are fitted on one side of the folding box. There are also further advantages, for example, when the tamperproof pack is closed, unauthorized opening of the box can be detected immediately. The folding box is machine-compatible; it is provided with adhesive when the blank is in the flattened-out state, is erected by the cartoning machine and is transported to the filling station, the hanging tab having already been formed on the folding box. The front and rear sides of the folding box provide excellent design possibilities. Once the folding box has been erected and filled, simple adhesive bonding of the head region and of the central region is possible. This adhesive bonding achieves good dustproofing, this dispensing with the need for the folding box to be fully wrapped subsequently or provided with additional packaging. The folding box is adhesively bonded, dustproof, provided with a tamperproof seal and recloseable; it is easy to handle and can be designed in various ways. Problem-free processing is possible. Furthermore, the folding box is environmentally friendly and is produced from a folding blank with minimum material consumption.

During assembly of the folding box, a hanging means is formed on the same, said hanging means being made up of two hanging tabs—and therefore of two layers of material. This has the advantage that the hanging means is characterized by high stability, with the result that it withstands even relatively high tensile loading without there being any risk of it being torn off. In particular if the two hanging tabs are adhesively bonded to one another, the result is a fixed composite arrangement, which may also be designed in an aesthetically pleasing manner. Apart from the hanging means, as far as the folding box is concerned, the walls, with the exception of envisaged adhesive-bonding areas, are otherwise of single-layer design in each case. This means that, overall, a very small amount of material is used up for designing the folding box, although a load-bearing hanging means is nevertheless formed.

The integration of the hanging means in the folding blank of the folding box lo allows the folding box to be completed within one operating step. The subsequent task, thus involving unnecessary outlay, of adhesively bonding a hanging means on the otherwise finished box is dispensed with.

The folding-box design according to the invention reduces the sources of disruption when the products, in particular plasters, are introduced into the folding box, because the latter does not contain in its interior any protruding edge on which the products may catch.

A particularly advantageous embodiment of the folding box along with the punched blank is explained in more detail, without there being any intention of thereby limiting the invention unnecessarily, with reference to the figures, which are described hereinbelow and in which:

BRIEF DESCRIPTION OF THE DRAWINGS

FIG. 1 illustrates the punched blank 10 of the folding box 1. The punched blank 10 may consist of cardboard, paperboard or another suitable material. The body of the erected folding box 1 is formed by the front side wall 11, the rear side wall 12, the right-hand side wall 13, which connects the front side wall 11 and the rear side wall 12, and the left-hand side wall 14. Since the tear-open tab 40, which is provided for opening the folding box 1, is retained in the rear side wall 12 by means of a weakening or predetermined tearing line 41 and is connected to a closure flap 32 of the top closure 30 via a folding line 302, the left-hand side wall 14 merely has articulated on it an inner rear wall 15, on which a tab 16 is located, it being possible for the tab 16 to be adhesively bonded to the right-hand side wall 13 for the purpose of non-releasable closure of the body of the folding box.

Figure 1:
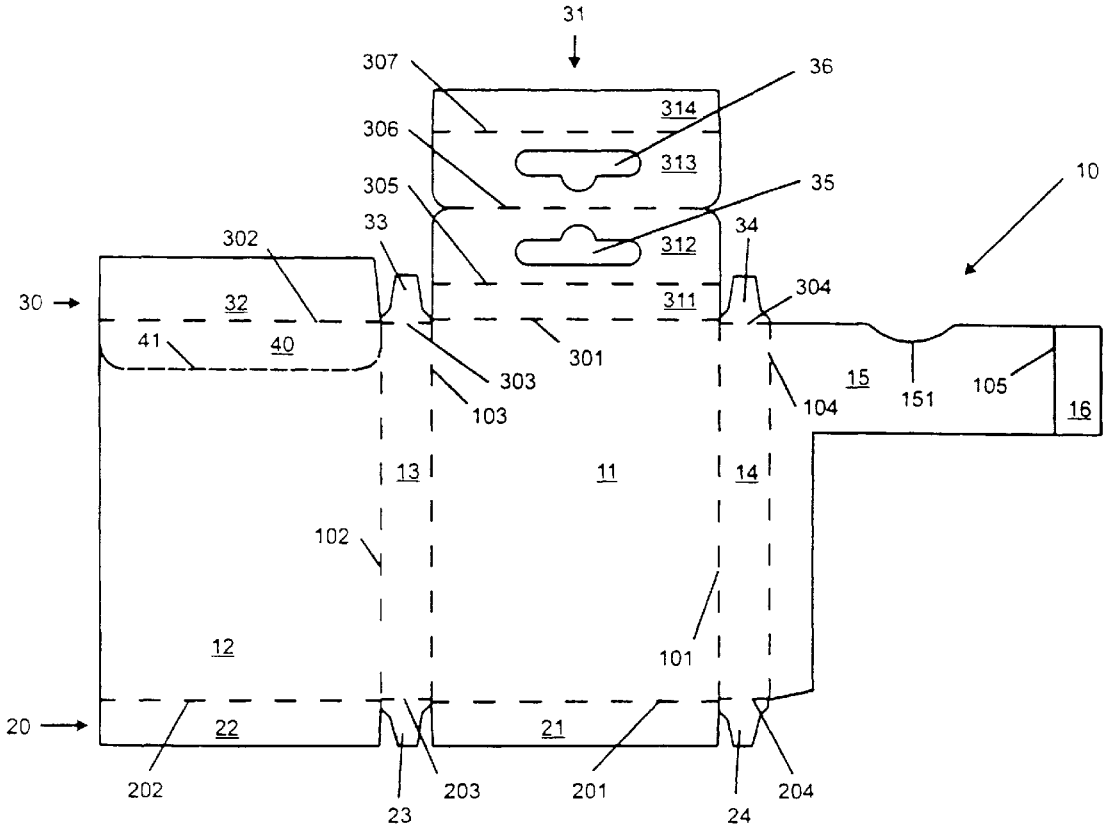
FIG. 1 shows the flattened-out, non-adhesively-bonded punched blank of the folding box of particularly advantageous design.

All the side walls 11, 12, 13, 14 are of rectangular shape, although the front side wall 11 and rear side wall 12, which are preferably of the same dimensions, are somewhat wider than the other two side walls 13, 14, which are likewise preferably of identical dimensions. The tab 16 is of such a width as to allow reliable adhesive bonding to the right-hand side wall 13, but is no wider than the two side walls 13, 14. Most of the inner rear wall 15 has been removed.

The individual side walls 11, 12, 13, 14, the inner rear wall 15 and the tab 16 are connected to one another via corresponding folding lines 101, 102,103, 104, 105.

The base closure 20 is made up of the four base closure flaps 21, 22, 23, 24, which are attached to the corresponding side walls 11, 12, 13, 14 by means of folding lines 201, 202, 203, 204. The base closure flap 21, which is articulated on the front side wall 11, and the base closure flap 22, which is articulated on the rear side wall 12 via the folding line 202, are preferably of rectangular shape. The length or height of the two base closure flaps 21, 22 advantageously corresponds more or less to the width of the two narrower side walls 13, 14, with the result that, when the folding box 1 has been erected, the base closure flaps 21, 22, which are swung inwards at an angle of 90E, overlap, and are advantageously adhesively bonded to one another, this providing the base closure 20 with increased protection against the penetration of dust or other particles of dirt. Two further base closure flaps 23, 24 are articulated on the two narrow side walls 13, 14 via the folding lines 203, 204, said further base closure flaps tapering towards their free end and being of essentially trapezoidal design.

The top closure 30 is formed from the four top closure flaps 31, 32, 33, 34, which are attached correspondingly to the side walls 11, 12, 13, 14 via the folding lines 301, 302, 303, 304. The two top closure flaps 33, 34 are preferably of the same shape and dimensions as the two base closure flaps 23, 24. On the front side wall 11 on the one hand said top closure flap 31 is articulated via a folding line 301 and on the other hand, on the opposite side, a base closure flap 21 is articulated via a folding line 201, it being the case that the top closure flap 31 is made up of a tab 311 which is articulated on the front side wall 12 via a folding line 301, of a first hanging tab 312 with a hanging device 35, which is articulated on the tab 311 via a folding line 305, of a second hanging tab 313 with a hanging device 36, which is articulated on the first hanging tab 312 via a folding line 306, of an end tab 314, which is articulated on the second hanging tab 313 via a folding line 307. The sum of the widths of the tab 311 and of the end tab 314 is no greater than the width of the top closure flap 32. In the case of the preferred embodiment of the folding box 1 illustrated here, the tab 311 and the end tab 314 are of the same width. In order to assemble the folding box 1, the closure flaps 33, 34 are first of all swung inwards at an angle of 90°, and then the closure flap 32 is swung over likewise through 90°. The closure flap 31 is first of all folded, with the result that the tab 311 and the end tab 314 rest on the closure flap 31 and are advantageously adhesively bonded to the same. The first hanging tab 312, which is essentially of rectangular shape, advantageously has centrally, in the centre of gravity of its surface area, a hanging device 35, which preferably displays a combination of slots and round holes, thus resulting in the generally preferred shape for such recesses, the so-called standard European hole, which allows secure but at the same time also flexible positioning of the full folding box 1 in a sales rack with correspondingly provided sales hooks. Articulated on the first hanging tab 312 is the second hanging tab 313, which is of the same shape and dimensions as the first hanging tab 312, the only difference being that the hanging device 36 is somewhat smaller than the hanging device 35 of the first hanging tab 312, but the second hanging tab is turned at an angle of 180° in relation to the first hanging tab 312, with the result that, when the second hanging tab 313 is bent over via the folding line 306, the two hanging tabs 312, 313 are located one above the other such that the two hanging devices 35, 36 are arranged congruently as far as possible.

The two hanging tabs 312, 313 may advantageously be adhesively bonded to one another, which increases the stability.

For reasons of appearance, it is also possible for the total of four free corners of the two hanging tabs 312, 313 to be rounded identically preferably in the form of quarter-circles.

In order to make it possible for the folding box to be stored in a particularly space-saving manner, the folding line 305 between the tab 311 and the first hanging tab 312 and the folding line 307 between the second hanging tab 313 and the end tab 314 may be designed as a severing perforation. This makes it possible for the hanging means, which is formed from the two hanging tabs 312, 313, to be removed without the rest of the folding box 1 being damaged.

Provided in the rear side wall 12 is an essentially rectangular tear-open tab 40 which can easily be torn out of the rear side wall 12 by way of a corresponding weakening or predetermined tearing line 41 and which is connected to the top closure flap 32 via a folding line 302. In order to open the top closure 30, the tear-open tab 40 is removed from the rear side wall 12 by virtue of the weakening or predetermined tearing line 41 being severed and is swung rearwards through, for example, 90° at the folding line 301 together with the top closure flap 31. In order to reclose the folding box 1, the tear-open tab 40 is inserted into the folding box 1, to be precise directly beneath the inner rear wall 15. A preferably round recess 151 is advantageously provided in the inner rear wall 15, said recess making it easier to open the folding box 1 again in that access to the tear-open tab 40 is possible by way of a finger or thumb.

Figure 2:
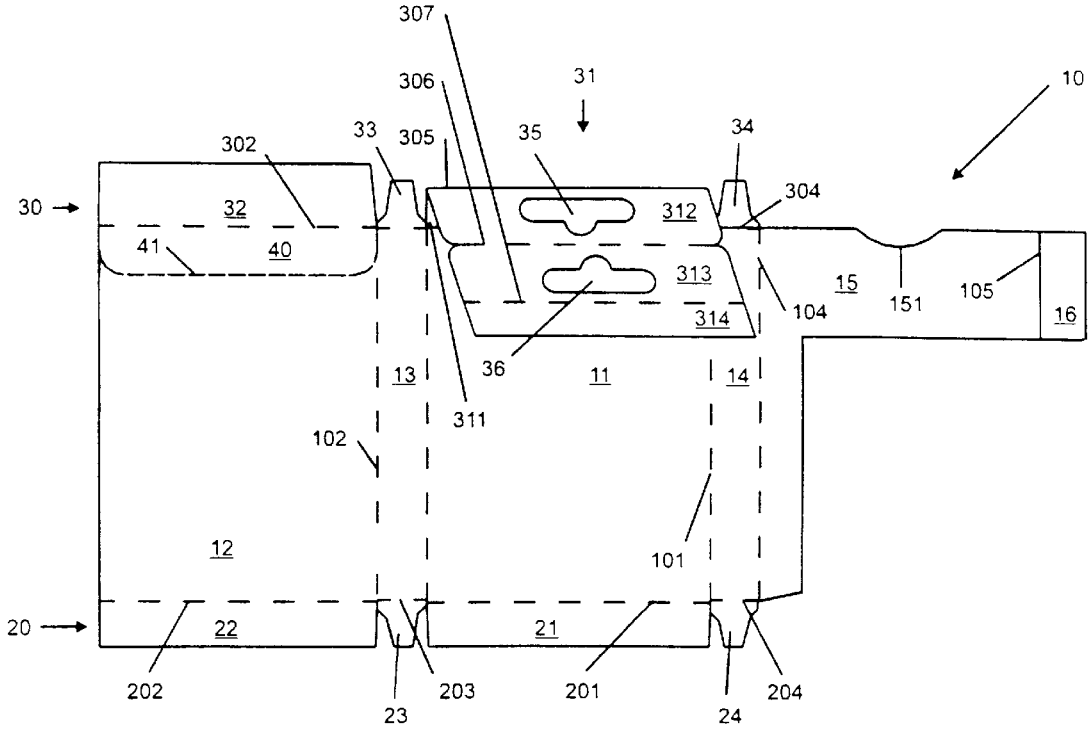
FIG. 2 to FIG. 4 show the operation of assembling a top closure flap of the folding box.
Figure 3:
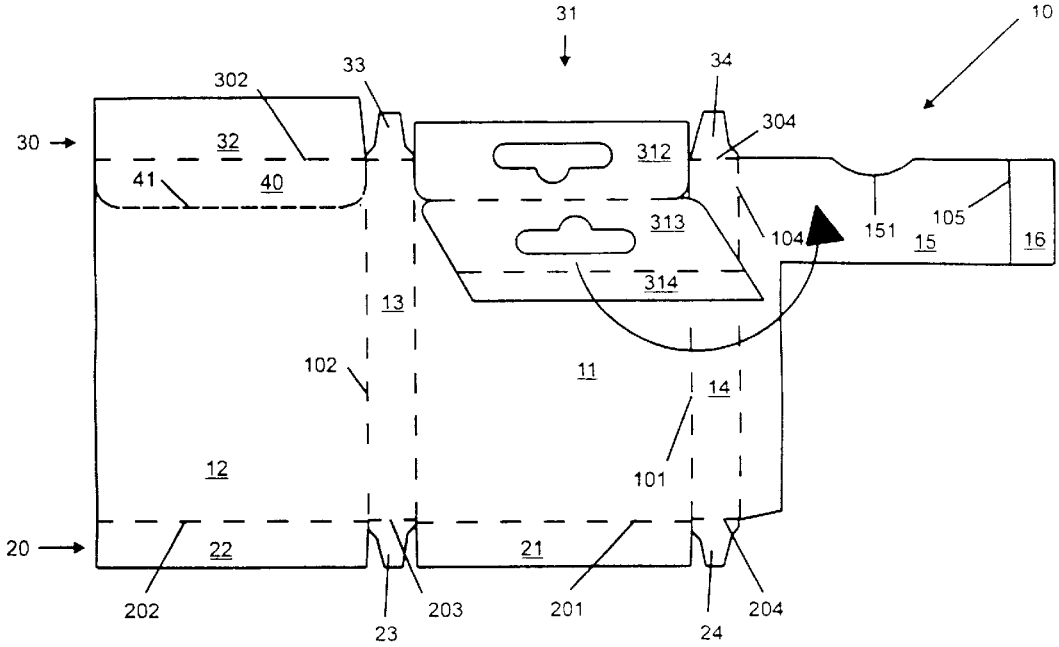
Figure 4:
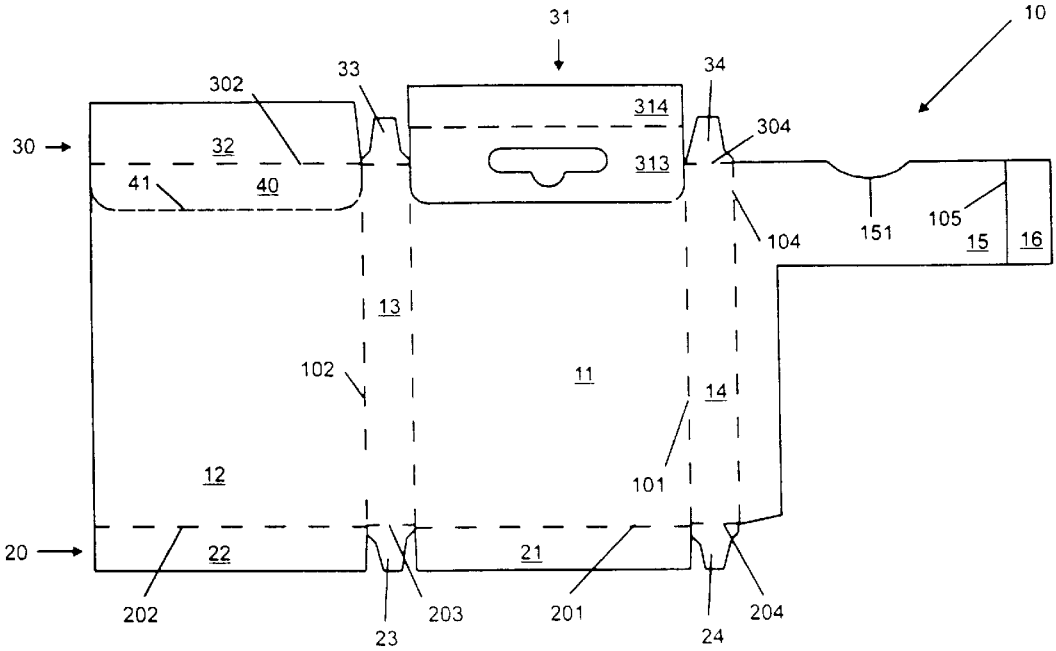

FIGS. 2, 3 and 4 show the operation of assembling the folding box 1. As is illustrated in FIG. 2, in order to erect the folding box 1, first of all the top closure flap 31 is transferred into the desired shape by the hanging tab 312, 313 with the end tab 314 being swung over outwards through 180°. Then, according to FIG. 3, the hanging tab 313 and the end tab 314 are folded back again through 180°, with the result that the two hanging tabs 312, 313 and the tab 311 and the end tab 314 are located one above the other (FIG. 4).

Figure 5:
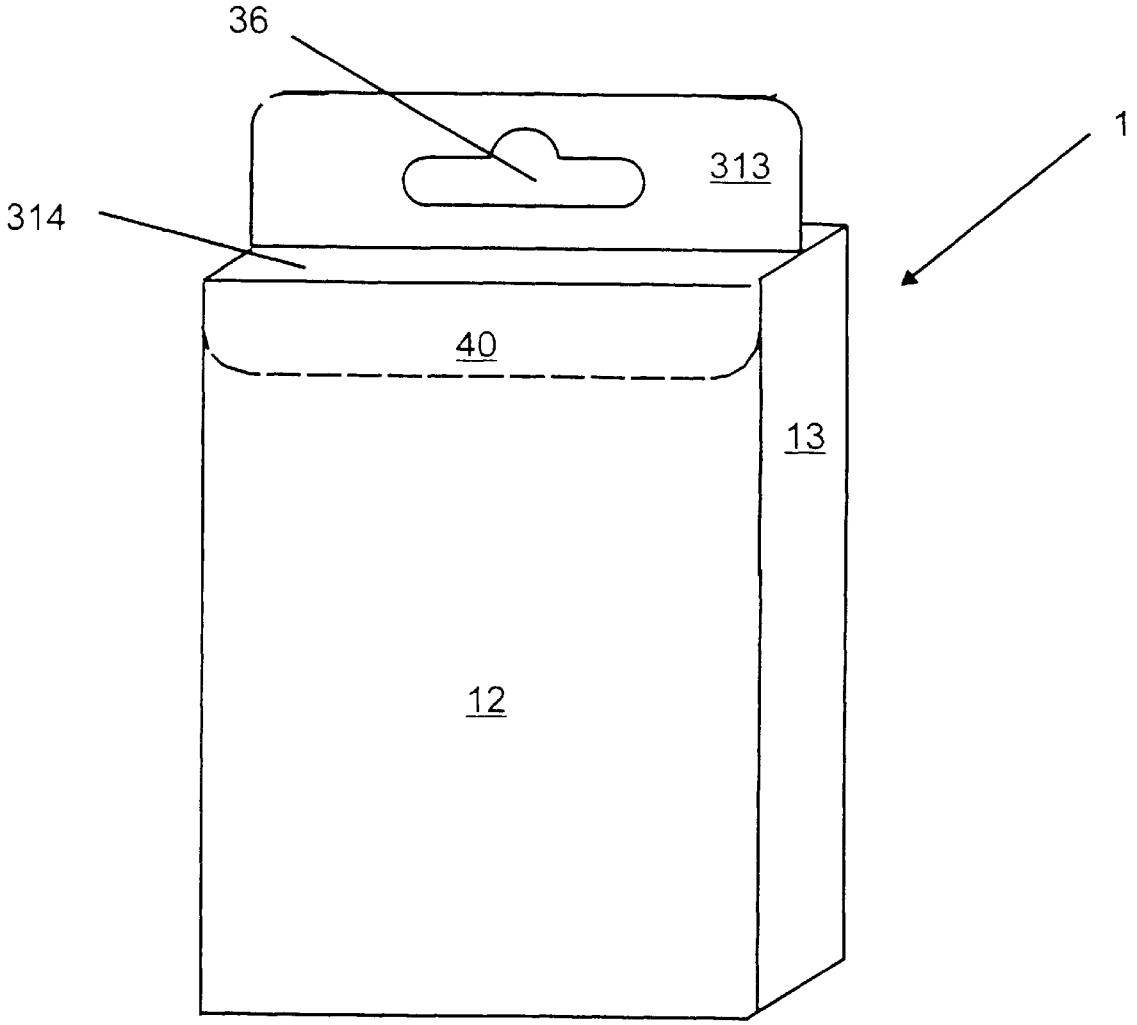
FIG. 5 shows the completed and closed folding box.

FIG. 5 shows the folding box 1 in the assembled and closed state. Once the cuboidal body has been formed from the intermediate wall 16, the inner rear wall 15, the left-hand side wall 14, the front side wall 11, the side wall 13 and the rear side wall 12, the intermediate wall 16 is adhesively bonded to the right-hand side wall 13, which connects the front side wall 11 and the rear side wall 12. The rear side wall 12 is folded over through a total of 180° and adhesively bonded to the inner rear wall 15. In the case of the base closure 20, the base closure flaps 23, 24, which are located on the narrower side walls 13, 14, are swung inwards through 90°, the base closure flap 22, which is located on the rear side wall 12, is folded onto the same, and then the base closure flap 21, which is located on the front side wall 11, is bent over correspondingly, adhesive bonding of the two base closure flaps 21, 22 likewise taking place here. In the case of the top closure 30, first of all the closure flaps 33, 34, which are located on the narrower side walls 13, 14, are swung inwards, and the closure flap 32, which is located on the rear side wall 12, is folded onto the same. Finally, the closure flap 31 formed according to FIGS. 2 and 3 is folded, the tab 311 and the end tab 314 being adhesively bonded to the closure flap 32 by virtue of a corresponding adhesive being applied. The two hanging tabs 312, 313 are advantageously also adhesively bonded to one another, with the result that the double material wall renders the hanging means of the folding box 1 extremely stable. This means that the top closure 30 and the base closure 20 of the folding box 1 cannot be opened without force being applied and are thus protected against theft and dustproof.

By virtue of the hanging means of the folding box 1 being folded back into the vertical position, the completed and closed folding box 1 is in the state in which it is supplied to the customer, who can than hang it in sales racks provided with hooks and advantageously display it for selling purposes.

All suitable adhesives may be used as the adhesive materials here.

Figure 6:
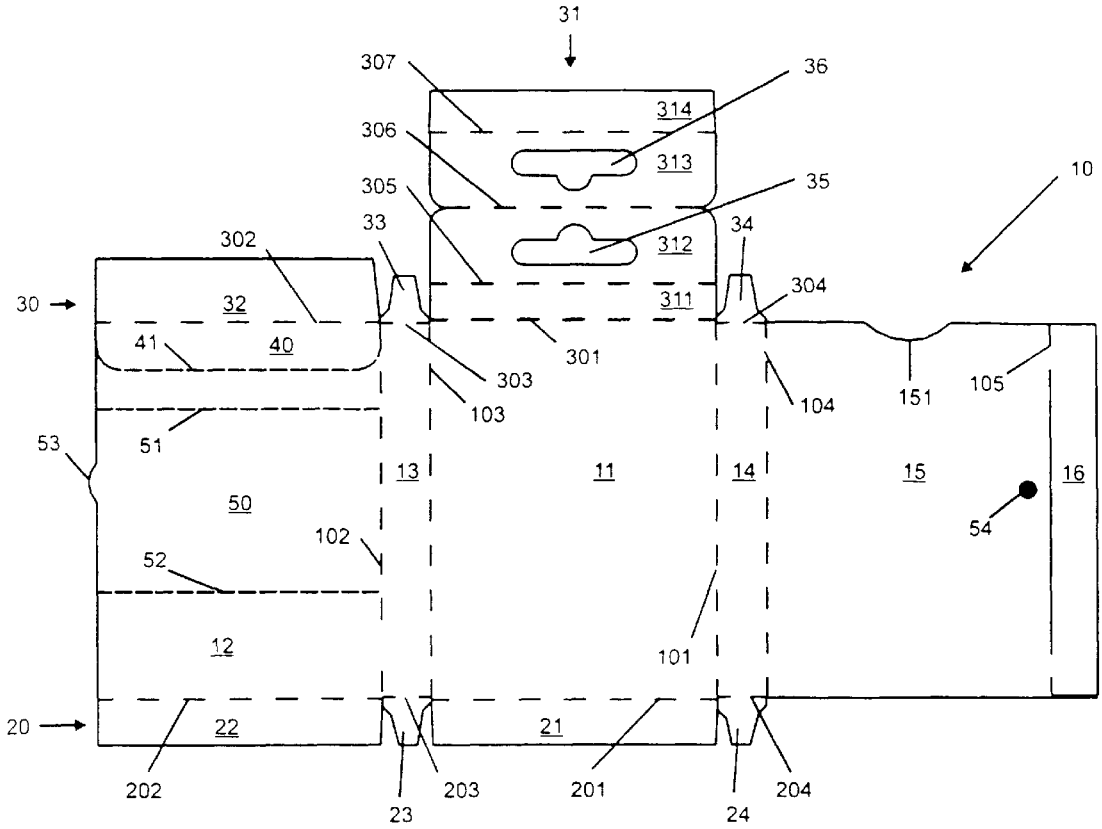
FIG. 6 shows the flattened-out, non-adhesively-bonded punched blank of a folding box of alternative design.

FIG. 6 shows the flattened-out, non-adhesively-bonded punched blank of a folding box 1 of alternative design, which is provided with a swing flap 50 on its rear side wall 12. The swing flap 50 is retained in the rear side wall 12 in this case by means of two weakening or predetermined tearing lines 51, 52. In order to open the swing flap 50, the two weakening or predetermined tearing lines 51, 52 are severed, and advantageously provided for this purpose, on the swing flap 50, is an, in particular, round protrusion 53, which makes it easier for the folding box 1 to be opened in that access to said protrusion 53 is possible by way of a finger or thumb. Reversible adhesive bonding of the swing flap 50 is ensured by the spot of adhesive 54 on the inner rear wall 15, the spot of adhesive 54 being formed by a pressure-sensitive adhesive.

What is claimed is:

1. A recloseable, cuboidal folding box having a front side wall, a rear side wall, a right-hand side wall, which connects the front side wall and the rear side wall; and a left-hand side wall, each of which has a top closure flap and a base closure flap, the base closure flaps on the front side wall and rear side wall optionally being adhesively bonded to each other; a tear-open tab integrated in the rear side wall and which is retained there by a weakening or predetermined tearing line, and which is connected to the top closure flap of the rear side wall via a folding line; at least one inner rear wall on which, optionally, an intermediate wall and, adjoining the intermediate wall, an inner front wall are articulated, and, wherein the top closure flap on the front side wall is articulated on the front side wall and is comprised of a) a plain tab which is articulated on the front side wall via a first folding line, b) a first hanging tab with a first hanging device, which is articulated on the plain tab via a second folding line, c) a second hanging tab with a second hanging device, which is articulated on the first hanging tab via a third folding line, d) an end tab, which is articulated on the second hanging tab via a fourth folding line; and wherein e) the sum of the widths of the plain tab and of the end tab is no greater than the width of the top closure flap of the rear side wall.

2. Recloseable, cuboidal folding box according to claim 1, wherein the inner rear wall and the rear side wall are adhesively bonded to one another.

3. Recloseable, cuboidal folding box according to claim 1, wherein the hanging device in the first hanging tab is larger than the hanging device in the second hanging tab.

4. Recloseable, cuboidal folding box according to claim 1, wherein, the first hanging tab and the second hanging tab are adhesively bonded to one another.

5. Recloseable, cuboidal folding box according to claim 1, wherein the plain tab and the end tab are of the same width.

6. Recloseable, cuboidal folding box according to claim 1, wherein a swing flap is integrated in the rear side wall by means of two weakening or predetermined tearing lines and is adhesively bonded in a reversible manner by means of at least one spot of adhesive.

7. A punch blank for producing a recloseable, cuboidal folding box having a front side wall, a rear side wall, a right-hand side wall, which connects the front side wall and the rear side wall, and a left-hand side wall, each of which has a top closure flap and a base closure flap, the base closure flaps of the front side wall and rear side wall optionally being adhesively bonded to each other, a tear-open tab which is integrated in the rear side wall and retained there by a weakening or predetermined tearing line and which is connected to the top closure flap of the rear side wall via a folding line; at least one inner rear wall on which, optionally, an intermediate wall and, adjoining the intermediate wall, an inner front wall are articulated, and wherein the folding box comprises a folding blank made of paperboard, cardboard or another suitable material, and on which the rear side wall, the right-hand side wall, which connects the front side wall and the rear side wall, the front side wall, the left-hand side wall, the inner rear wall and, optionally, an intermediate wall and, adjoining the intermediate wall, an inner front wall are arranged one behind the other in a straight line such that they are attached to one another in a row via folding lines and wherein, on the top of the right-hand side wall, which connects the front side wall and the rear side wall, a top closure flap is articulated via a folding line and on the bottom side of the right-hand side wall, a base closure flap is articulated via a folding line, and at the top of the front side wall a closure flap is articulated via a folding line and, at the bottom of the front side wall, a base closure flap is articulated via a folding line and wherein the top closure flap is made up of a plain tab which is articulated on the front side wall via a first folding line, a first hanging tab with a first hanging device, which is articulated on the plain tab via a second folding line, a second hanging tab with a second hanging device, which is articulated on the first hanging tab via a third folding line and an end tab which is articulated on the second hanging tab via a fourth folding line and wherein the sum of the widths of the plain tab and of the end tab is no greater than the width of the top closure flap and wherein, at the top of the left-hand side wall a top closure flap is articulated via a folding line and, at the bottom of the left-hand side wall, a base closure flap is articulated via a folding line and wherein an optionally round grip recess is provided at the top of the inner rear wall and a tear-open tab 40 is integrated in the rear side wall and is retained there by means of a weakening or predetermined tearing line and is connected to the top closure flap of the rear side wall via a folding line, and a swing flap is optionally integrated in the rear side wall by means of two weakening or predetermined tearing lines and is adhesively bonded in a reversible manner by at least one spot of adhesive.

* * * * *